US007144018B1

(12) United States Patent
Chen

(10) Patent No.: US 7,144,018 B1
(45) Date of Patent: Dec. 5, 2006

(54) IN-LINE SKATE

(76) Inventor: Wang-Chuan Chen, No. 37, Lane 278, Hai Wei Road, Taichung Hsien, Lung Ching Hsiang (TW)

( * ) Notice: Subject to any disclaimer, the term of this patent is extended or adjusted under 35 U.S.C. 154(b) by 0 days.

(21) Appl. No.: 11/162,396

(22) Filed: Sep. 8, 2005

(51) Int. Cl.
*A63C 1/26* (2006.01)

(52) U.S. Cl. ..... 280/11.221; 280/11.12; 280/11.26; 280/11.27; 280/11.231; 280/11.19

(58) Field of Classification Search .... 280/11.2–11.27, 280/11.221–11
See application file for complete search history.

(56) References Cited

U.S. PATENT DOCUMENTS

| | | | | |
|---|---|---|---|---|
| 5,645,288 | A * | 7/1997 | Lu | 280/11.26 |
| 6,217,039 | B1 * | 4/2001 | Iverson et al. | 280/11.26 |
| 6,450,510 | B1 * | 9/2002 | Liu | 280/11.26 |
| 6,916,027 | B1 * | 7/2005 | Chen | 280/11.26 |
| 6,918,601 | B1 * | 7/2005 | Sauter et al. | 280/11.26 |

* cited by examiner

*Primary Examiner*—J. Allen Shriver
*Assistant Examiner*—Cynthia F. Collado
(74) *Attorney, Agent, or Firm*—Alan D. Kamrath; Nikolai & Mersereau, P.A.

(57) ABSTRACT

There is disclosed an in-line skate with an adjustable length. The in-line skate includes a heel support, a toe support, a positioning element, a pushing element, and a switch. The heel support includes two parallel transverse grooves near a flank, a cavity near an opposite flank, a longitudinal groove between the transverse grooves and the cavity, and a slot therein. The toe support includes a slide put movably in the longitudinal groove and a series of pockets in the slide. The positioning element includes a button put movably in the cavity and two latches put movably in the transverse grooves of the heel support for entering a selective pair of the pockets of the toe support, thus keeping the toe support in selective one of several positions relative to the heel support. The pushing element is put movably in the cavity for pushing the button and hence the latches. The pushing element defines a tunnel. The switch includes a connection device fit in the tunnel in order to connect the switch to the pushing element. The switch is movable along and exposed through the slot for easy operation.

6 Claims, 5 Drawing Sheets

IN-LINE SKATE

BACKGROUND OF INVENTION

1. Field of Invention

The present invention relates to an in-line skate.

2. Related Prior Art

A typical in-line skate includes a length-adjusting device by which the length thereof can be adjusted. A typical length-adjusting device includes a screw and a nut engaged with the screw. The operation of the adjusting device is troublesome and takes a lot of time. The adjustment of the length of the in-line skate cannot be done quickly.

Furthermore, the adjusting device includes numerous elements that involve a complicated assembling process. Therefore, the producing process cannot be simplified. Accordingly, the costs of the in-line skate cannot be reduced and is not suitable for use in the current industry.

The present invention is therefore intended to obviate or at least alleviate the problems encountered in prior art.

SUMMARY OF INVENTION

An objective of the present invention is to provide an in-line skate with an easily adjustable length.

Another objective of the present invention is to provide a simple and in-expensive in-line skate.

To achieve the foregoing objectives, there is disclosed an in-line skate with an adjustable length. The in-line skate includes a heel support, a toe support, a positioning element, a pushing element, and a switch. The heel support includes two parallel transverse grooves near a flank, a cavity near an opposite flank, a longitudinal groove between the transverse grooves and the cavity, and a slot therein. The toe support includes a slide put movably in the longitudinal groove and a series of pockets in the slide. The positioning element includes a button put movably in the cavity and two latches put movably in the transverse grooves of the heel support for entering a selective pair of the pockets of the toe support, thus keeping the toe support in selective one of several positions relative to the heel support. The pushing element is put movably in the cavity for pushing the button and hence the latches. The pushing element defines a tunnel. The switch includes a connection device fit in the tunnel in order to connect the switch to the pushing element. The switch is movable along and exposed through the slot for easy operation.

Other objectives, advantages and novel features of the invention will be more apparent from the following detailed description in conjunction with the drawings.

BRIEF DESCRIPTION OF DRAWINGS

The present invention will be described through detailed description of the preferred embodiment referring to the drawings.

DETAILED DESCRIPTION OF PREFERRED EMBODIMENT

Figure 1:
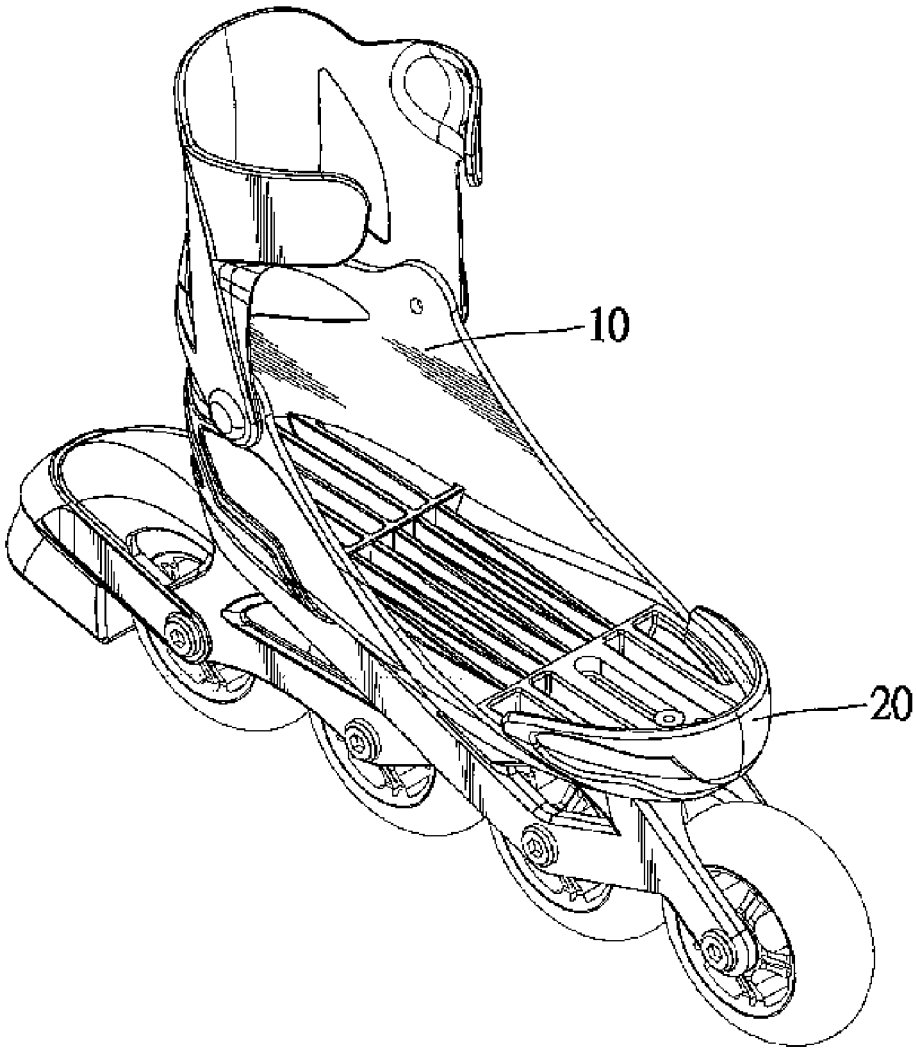
FIG. 1 is a perspective view of an in-line skate according to the preferred embodiment of the present invention.

Referring to FIG. 1, there is shown an in-line skate according to the preferred embodiment of the present invention. The in-line skate includes a heel support 10 and a toe support 20 movably connected to the heel support 10. They can be moved towards each other in order to fit a small foot. They can be moved away from each other in order to fit a big foot.

Figure 2:
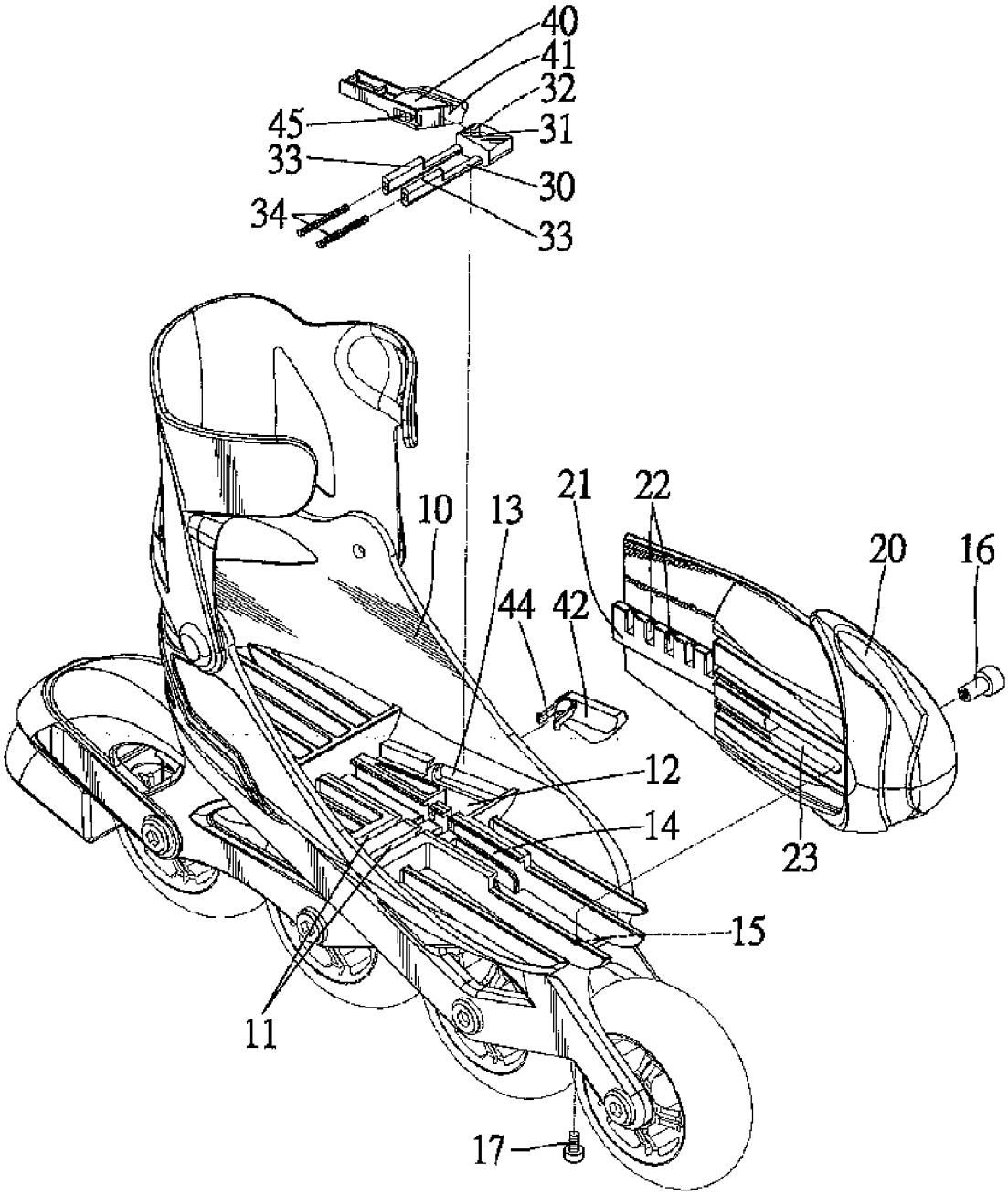
FIG. 2 is an exploded view of the in-line skate shown in FIG. 1.
Figure 3:
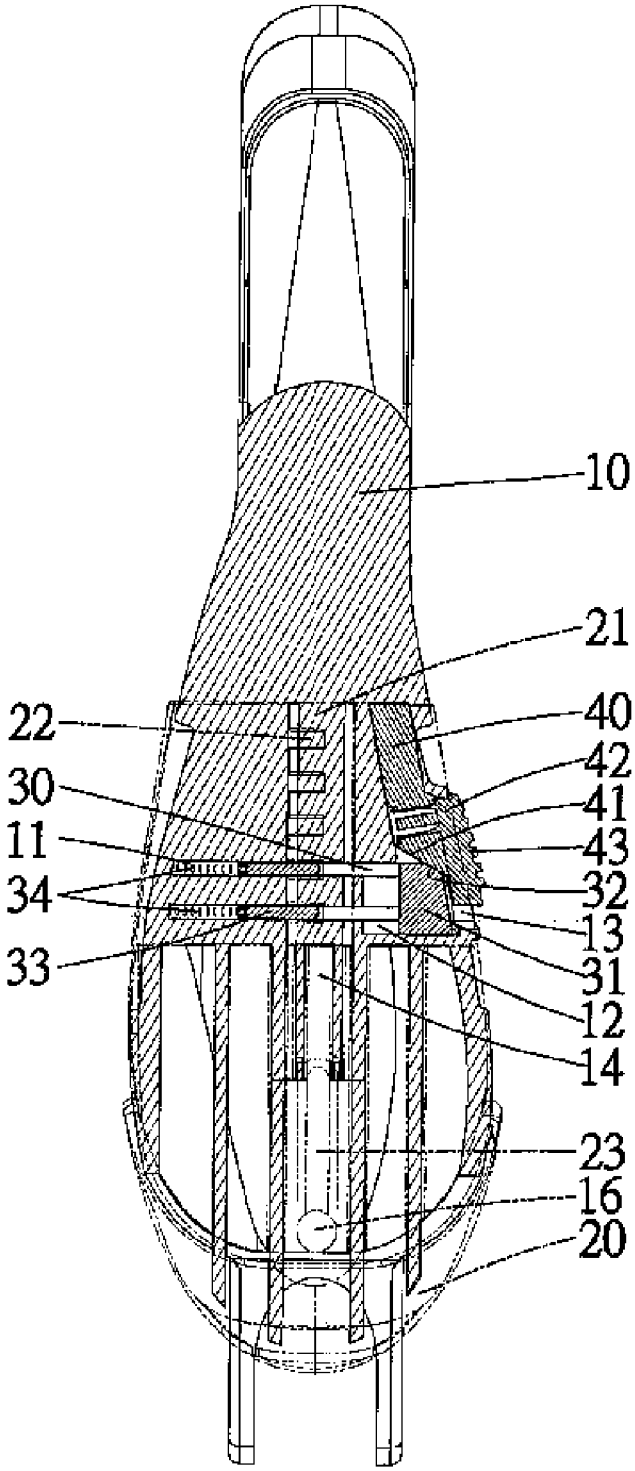
FIG. 3 is a cross-sectional view of the in-line skate shown in FIG. 1.

Referring to FIGS. 2 and 3, the heel support 10 includes two parallel transverse grooves 111 near a flank and an L-shaped cavity 12 near an opposite flank. A slot 13 is defined in the flank of the heel support 10 near the L-shaped cavity 12. Between the transverse grooves 111 and the L-shaped cavity 12, a longitudinal groove 14 is defined in the heel support 10. An aperture 15 is defined in the heel support 10.

The toe support 20 includes a slide 21 near an end and a slot 23 near an opposite end. A plurality of pockets 22 is defined in the slide 21. The slide 21 is put movably in the longitudinal groove 14 so that the toe support 20 can move on the heel support 10 smoothly. A restraint 16, in the form of a mushroom, is inserted through the longitudinal slot 23. A screw 17 is inserted through the aperture 15. The screw 17 is driven into the restraint 16. Thus, the movement of the toe support 20 on the heel support 10 is limited to the length of the slot 23.

A positioning element 30 is provided between the heel support 10 and the toe support 20 in order to keep them in selective one of several relative positions. The positioning element 30 includes a button 31 at an end and two latches 33 at an opposite end. The button 31 includes an inclined portion 32. The button 31 is put movably in the L-shaped cavity 12. The latches 33 are put movably in the transverse grooves 11. The latches 33 can enter a selective pair of the pockets 22 in order to keep the heel support 10 and the toe support 20 in selective one of the relative positions. The latches 33 can be moved from the pockets 22 in order to allow the relative movement between the heel support 10 and the toe support 20. An elastic element 34, a helical spring, is put in each of the transverse grooves 11 against related one of the latches 33. The elastic elements 34 are used to push the latches 33 into the pockets 22.

A pushing element 40 is used to push the positioning element 30. The pushing element 40 includes an inclined portion 41 corresponding to the inclined portion 32 of the positioning element 30. A tunnel 45 is defined in the pushing element 40. The pushing element 40 is put in the L-shaped cavity 12. The inclined portion 41 of the pushing element 40 is put movably against the inclined portion 32 of the button 31.

A switch 42 is used to move the pushing element 40. The switch 42 includes a friction portion 43 on a side and a connection device on an opposite side. The connection device includes two hooks 44 preferably. The switch 42 is put movably in the slot 13. The hooks 44 are inserted through the tunnel 45 so that the switch 42 is hooked to the positioning element 40. The friction portion 43 includes a plurality of edges. The friction portion 43 is used to facilitate the maneuvering of the switch 42.

Figure 4:
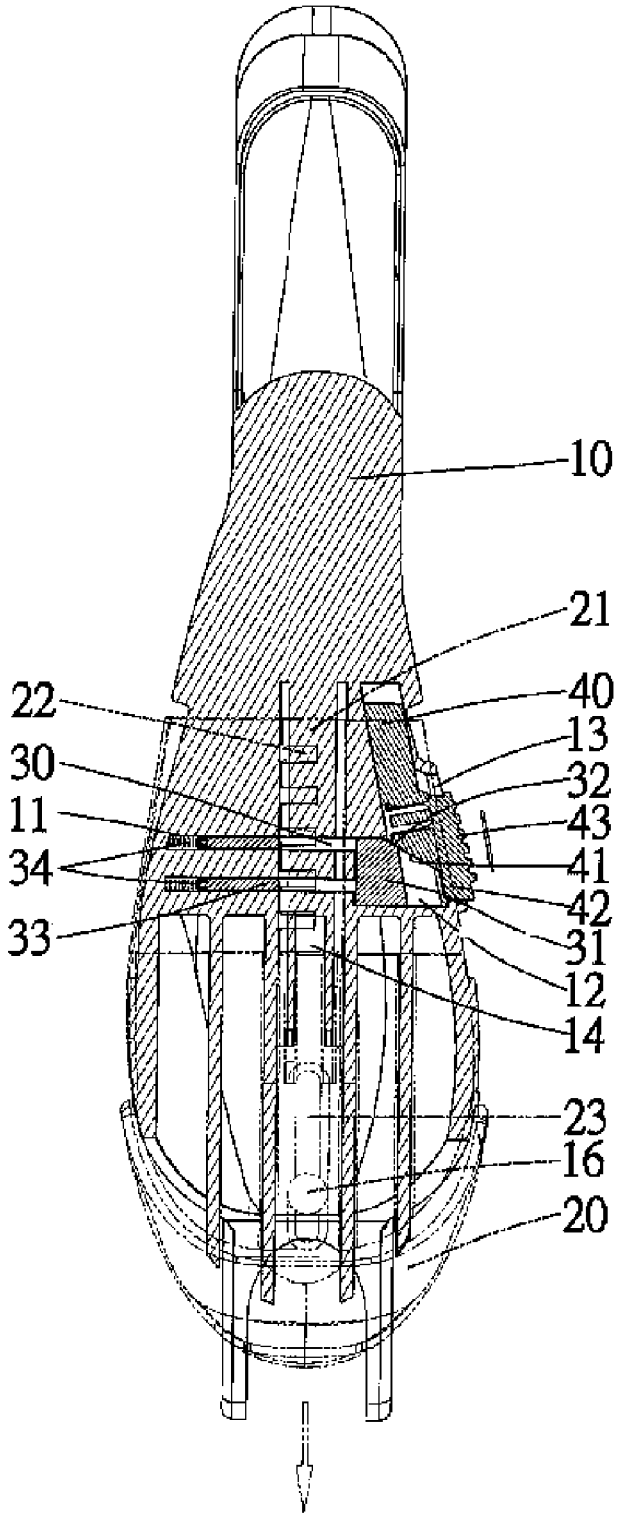
FIG. 4 is similar to FIG. 3 but shows the in-line skate ready in an adjusting process.

Referring to FIG. 4, with a finger on the friction portion 43, a user moves the switch 42 in a direction from the heel support 10 to the toe support 20. The switch 42 moves the pushing element 40. The longitudinal movement of the pushing element 40 results in the transverse movement of the positioning element 30 for the inclined portion 41 of the former slides on the inclined portion 32 of the latter. The latches 33 are moved from the pockets 22. Hence, the heel support 10 and the toe support 20 can be moved relative to each other. The elastic elements 34 are compressed against the latches 33.

Figure 5:
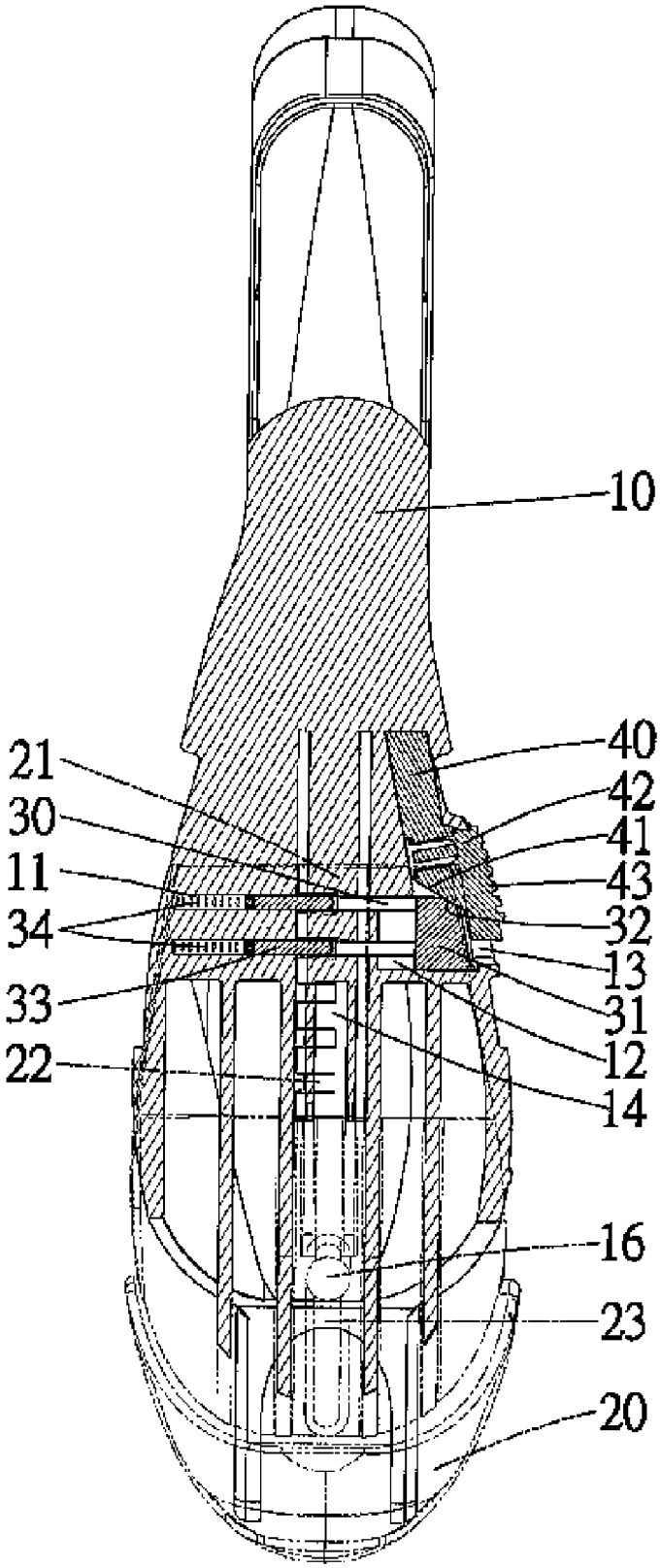
FIG. 5 is similar to FIG. 4 but shows the in-line skate after the adjusting process.

Referring to FIG. 5, the length of the in-line skate is adjusted. Then, the switch 42 is released. The elastic elements 34 push back the latches 33 so that the latches 33 slide into a selective pair of the pockets 22. Hence, the relative position is kept. The button 31 pushes back the pushing element 40 that in turn pushes back the switch 42.

An advantage of the in-line skate according to the present invention is that its length can easily be adjusted.

Another advantage of the in-line skate according to the present invention is its simple structure and therefore low cost.

The present invention has been described through the detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. An in-line skate with an adjustable length comprising:

a heel support comprising two parallel transverse grooves near a flank, a cavity near an opposite flank, a longitudinal groove between the transverse grooves and the cavity, and a slot therein;

a toe support comprising a slide put movably in the longitudinal groove and a series of pockets in the slide;

a positioning element comprising a button put movably in the cavity and two latches put movably in the transverse grooves of the heel support for entering a selective pair of the pockets of the toe support, thus keeping the toe support in selective one of several positions relative to the heel support;

a pushing element put movably in the cavity for pushing the button and hence the latches, the pushing element defining a tunnel; and a switch comprising a connection device fit in the tunnel in order to connect the switch to the pushing element, the switch being movable along and exposed through the slot for easy operation.

2. The in-line skate according to claim 1 wherein the button comprises an inclined portion, wherein the pushing element comprises an inclined portion in contact with the inclined portion of the button.

3. The in-line skate according to claim 1 comprising an elastic element in each of the transverse grooves for pushing back related one of the latches.

4. The in-line skate according to claim 1 wherein the switch comprises a friction portion thereon.

5. The in-line skate according to claim 1 wherein the connection device comprises two hooks.

6. The in-line skate according to claim 1 comprising a restraint installed on the heel support, wherein the toe support comprises a longitudinal slot for receiving the restraint, thus restraining the movement of the toe support relative to the heel support.

* * * * *